US006629897B2

(12) United States Patent
Belknap

(10) Patent No.: US 6,629,897 B2
(45) Date of Patent: Oct. 7, 2003

(54) RACK LOCATOR FOR BILLIARDS TABLE

(76) Inventor: John Curtis Belknap, 1084 Kirk Ave., Worthington, OH (US) 43085

( * ) Notice: Subject to any disclaimer, the term of this patent is extended or adjusted under 35 U.S.C. 154(b) by 9 days.

(21) Appl. No.: 09/871,461

(22) Filed: May 31, 2001

(65) Prior Publication Data

US 2002/0032068 A1 Mar. 14, 2002

Related U.S. Application Data

(60) Provisional application No. 60/212,403, filed on Jun. 19, 2000.

(51) Int. Cl.[7] ..... A63F 9/24; A63D 15/00

(52) U.S. Cl. ..... 473/40; 473/26; 473/4

(58) Field of Search ..... 473/1, 2, 22, 21, 473/26, 40, 41, FOR 1

(56) References Cited

U.S. PATENT DOCUMENTS

| | | | | | |
|---|---|---|---|---|---|
| 479,213 | A | | 7/1892 | Fuchs | |
| 484,562 | A | * | 10/1892 | Sweet | 473/40 |
| 850,360 | A | * | 4/1907 | Flint | 473/40 |
| 1,115,911 | A | * | 11/1914 | Dickinson | 473/40 |
| 1,127,318 | A | | 2/1915 | Thomas | |
| 1,246,436 | A | | 11/1917 | Kitzeman | |
| 3,140,093 | A | | 7/1964 | Singer | |
| 3,466,038 | A | | 9/1969 | Hill | |
| 3,752,588 | A | | 8/1973 | Chapman | |
| 4,251,077 | A | * | 2/1981 | Pelz et al. | 473/222 |
| 4,553,750 | A | * | 11/1985 | Kintz | 473/40 |
| 4,688,796 | A | | 8/1987 | Wright | |
| 4,882,676 | A | | 11/1989 | Van De Kop et al. | |
| 5,330,188 | A | * | 7/1994 | Reimers | 473/151 |
| 5,554,075 | A | | 9/1996 | Glazer | |
| 5,588,216 | A | | 12/1996 | Rank et al. | |
| 5,593,354 | A | * | 1/1997 | Falossi et al. | 473/220 |
| 5,630,759 | A | | 5/1997 | Lee | |
| 5,738,595 | A | | 4/1998 | Carney | |

* cited by examiner

*Primary Examiner*—Paul T. Sewell
*Assistant Examiner*—Mitra Aryanpour
(74) *Attorney, Agent, or Firm*—Sand & Sebolt

(57) ABSTRACT

A rack for a billiards table includes an indicator that produces an indication signal when the rack is properly positioned on a billiards table. The rack may include a device that produces a light beam. The rack may also include a diffuser or a photodetector that creates a signal when it receives a light beam. The light beam may be reflected back from an element positioned on the table or may emanate from the table.

12 Claims, 5 Drawing Sheets

RACK LOCATOR FOR BILLIARDS TABLE

CROSS REFERENCE TO RELATED APPLICATIONS

This application claims priority from U.S. Provisional Application Ser. No. 60/212,403 filed Jun. 19, 2000, the disclosures of which are incorporated herein by reference.

BACKGROUND OF THE INVENTION

1. Technical Field

The present invention generally relates to billiards equipment and, more particularly, to a billiards table and ball rack that provide an indication signal when the ball rack is perfectly positioned on the table. Specifically, the present invention relates to a billiards ball rack and billiards table with a pair of light mounted on one of the rack and table to provide an indication signal when the rack is perfectly positioned on the table.

2. Background Information

Most billiards games require the billiards balls to be racked at one side of the table. A rack is typically a grouping of balls in a triangle or diamond shape that is square to the table with the lead ball positioned directly over the foot spot. In the past, the rack was positioned and aligned by hand based on the judgment of the person racking the balls. The art thus desires a device that tells the person racking the balls when the rack is perfectly aligned with the table.

BRIEF SUMMARY OF THE INVENTION

In view of the foregoing, the present invention provides a device that creates an indication signal when the rack is perfectly positioned on a billiards table. The indication signal may be visual or audio and may emanate from the rack or the table.

In one embodiment, the invention does not require the billiards table to be modified. In another embodiment, the invention provides an indicator for a rack that uses light beams to align the rack on the table. In a further embodiment, the invention provides an indicator for a rack wherein a pair of signals are used to perfectly align the rack with respect to the table.

BRIEF DESCRIPTION OF THE SEVERAL VIEWS OF THE DRAWINGS

The preferred embodiments of the invention, illustrative of the best mode in which applicant contemplated applying the principles of the invention, are set forth in the following description and are shown in the drawings and are particularly and distinctly pointed out and set forth in the appended claims.

Similar numbers refer to similar parts throughout the specification.

DETAILED DESCRIPTION OF THE INVENTION

Figure 1:
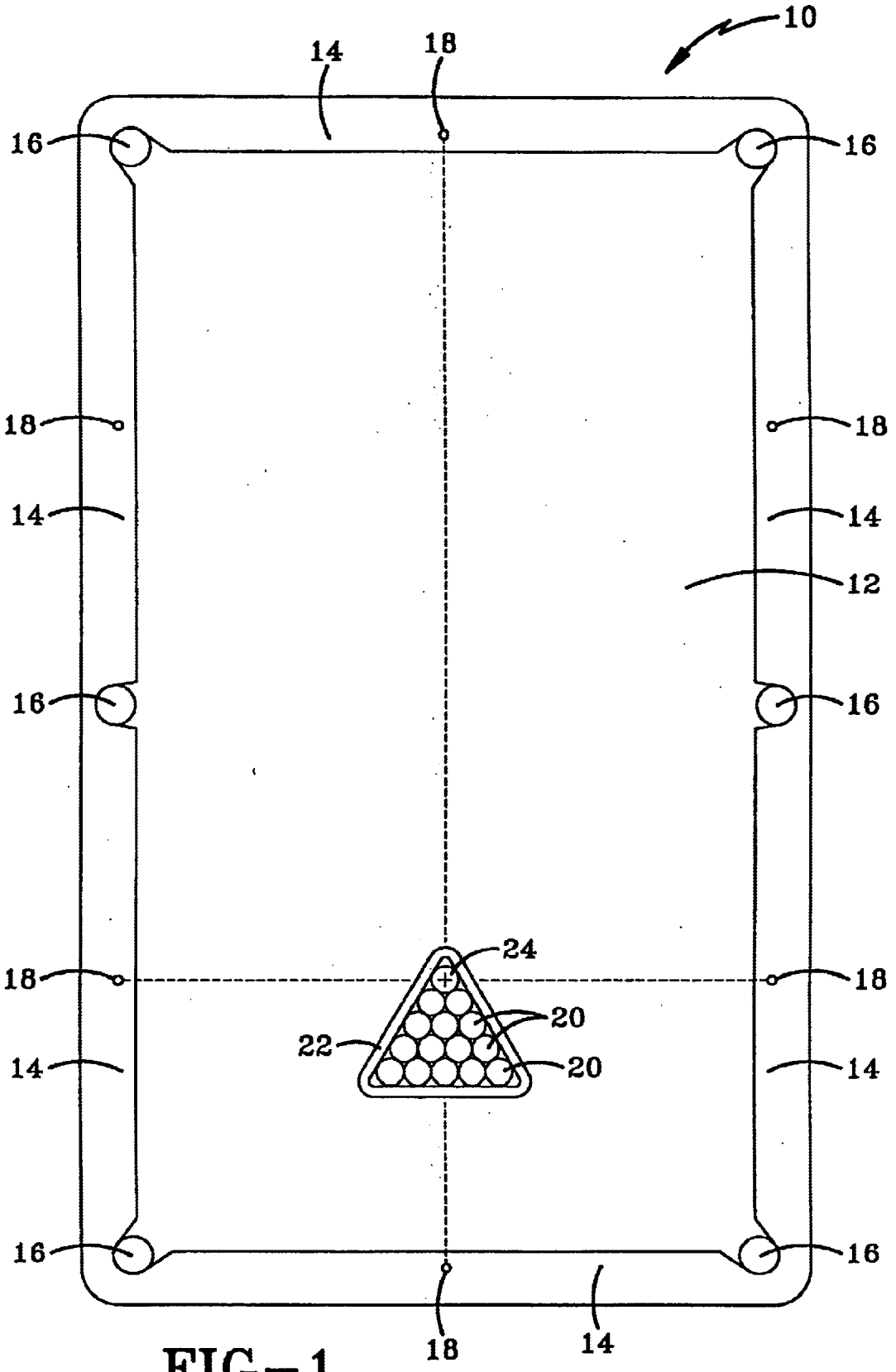
FIG-1 PRIOR ART
FIG. 1 is a top view of a prior art billiards table with the rack in the aligned position.

A prior art billiards or pool table is depicted in FIG. 1 and is indicated generally by the numeral 10. Table 10 includes a playing surface 12, a plurality of rails or bumpers 14, and a plurality of pockets 16 disposed between bumpers 14. An alignment marker 18 is centrally disposed between each pocket 16. Alignment markers 18 are used to rack the billiards balls 20. Balls 20 are racked in a rack 22 that is typically triangular but may also be diamond-shaped. The user of rack 22 places all 15 balls in rack 22 and then centers the forward ball 24 at the longitudinal center line of table 10 by visually aligning forward ball 24 between the longitudinal marks 18. Rack 22 is typically positioned at one end of table 10 between another pair of marks 18 as depicted in FIG. 1. The problem with this alignment method is that the user can easily misalign rack 22 and may not position rack 22 square to table 10 even though forward ball 24 is correctly positioned.

Figure 2:
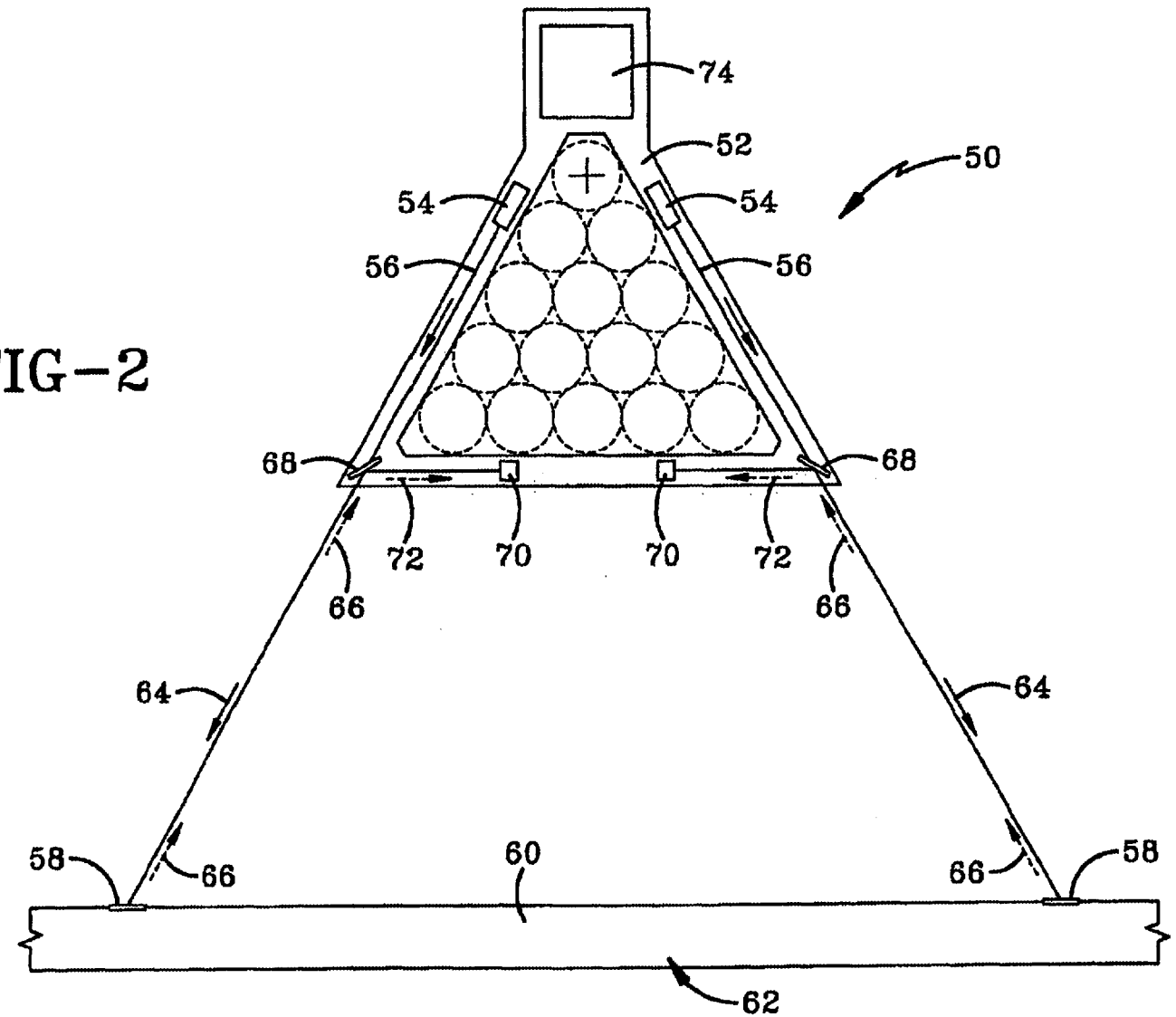
FIG. 2 is a top schematic view of the first embodiment of the invention.

The first embodiment of the rack locator system of the present invention is indicated generally by the numeral 50 in FIG. 2. System 50 includes a rack 52 having a pair of light sources 54 mounted on opposite sides of rack 52. Light sources 54 may be embedded within the sides of rack 52 or may be mounted on the upper surfaces of the sides of rack 52. Light sources 54 may be lasers, light emitting diodes, or other sources of light as are known in the art. Light sources 54 preferably emit a substantially collimated light beams 56 parallel to the sides of rack 52.

System 50 further includes a pair of retroreflective elements 58 positioned on foot rail 60 of the billiards table 62. Retroreflective elements 58 reflect light beams 56 substantially in the opposite direction as indicated by arrows 64 and 66. Arrow 64 represents the incoming beam while arrow 66 indicates the reflected beam.

System 50 further includes a pair of beam splitting elements 68 positioned on rack 52 in a position to receive reflected beams 66. A pair of photodetectors 70 are also carried by rack 52 in a position to receive the redirected beams 72. Photodetectors 70 are capable of recognizing the receipt of beam 72 and producing an electric signal which is communicated to an electronic module 74 that produces an indication signal when photodetectors 70 receive beams 72. The indication signal may be a light, a sound, or another type of indication signal known in the art. The electronic circuitry required to produce the signal is understood by those skilled in the art. Such circuitry will include an arrangement that recognizes the signal from photodetectors 70 and creates the indication signal and response to the signal. Module 74 may further include a power source that is preferably replaceable so that the user may easily change the power source periodically.

With system 50, the user racks the billiards balls by placing the balls in rack 52. The user then positions rack 52 on table 62 until light beams 56 align with retroreflectors 58 to reflect beam 64 as beam 66 into elements 68. When this occurs, photodetectors 70 receive beam 72 and create a signal to module 74 where the indication signal is created. At this point, the user knows that rack 52 is properly positioned on table 62.

System 50 requires retroreflective elements 58 to be positioned along foot rail 60 but otherwise requires no modification to table 62. Those skilled in the art understand that the elements of system 50 may be arranged in various configurations with respect to rack 52 without departure from the concepts of the present invention.

Figure 3:
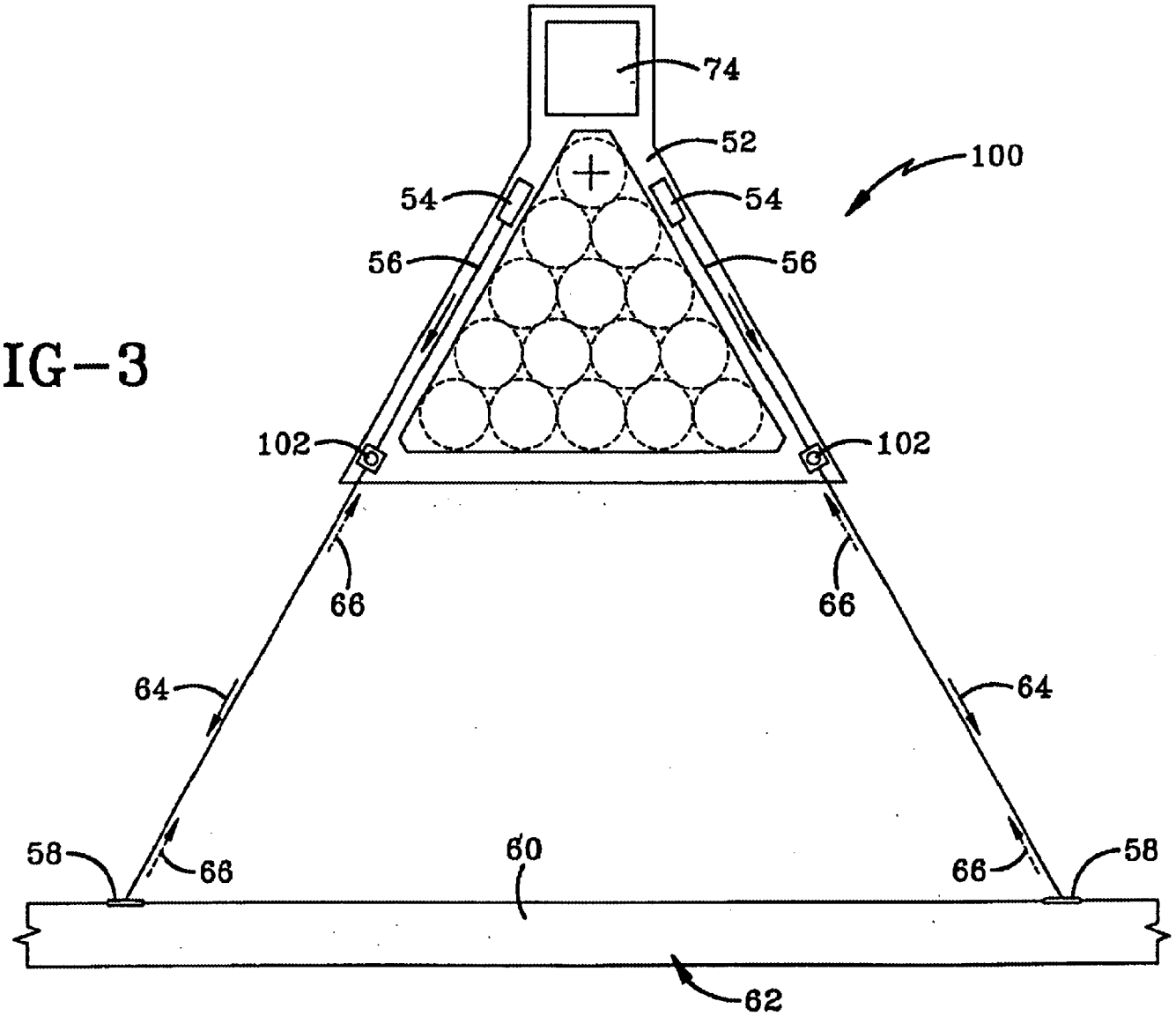
FIG. 3 is a view similar to FIG. 2 showing the top schematic of a second embodiment of the invention.

A second embodiment of the system of the present invention is indicated generally by the numeral 100 in FIG. 3. System 100 includes many of the same elements as system 50 described above and the same numbers are referred to those elements. The difference between system 100 and system 50 is that photodetectors 70 are removed and replaced with diffusers 102 that are disposed directly in line with beam 66. Diffusers 102 receive beam 66 and diffuse beam 66 so that they are visible to the user. In this embodiment, module 74 is only needed to power light sources 54. Module 74 may also have an on/off switch that activate light sources 54.

Figure 4:
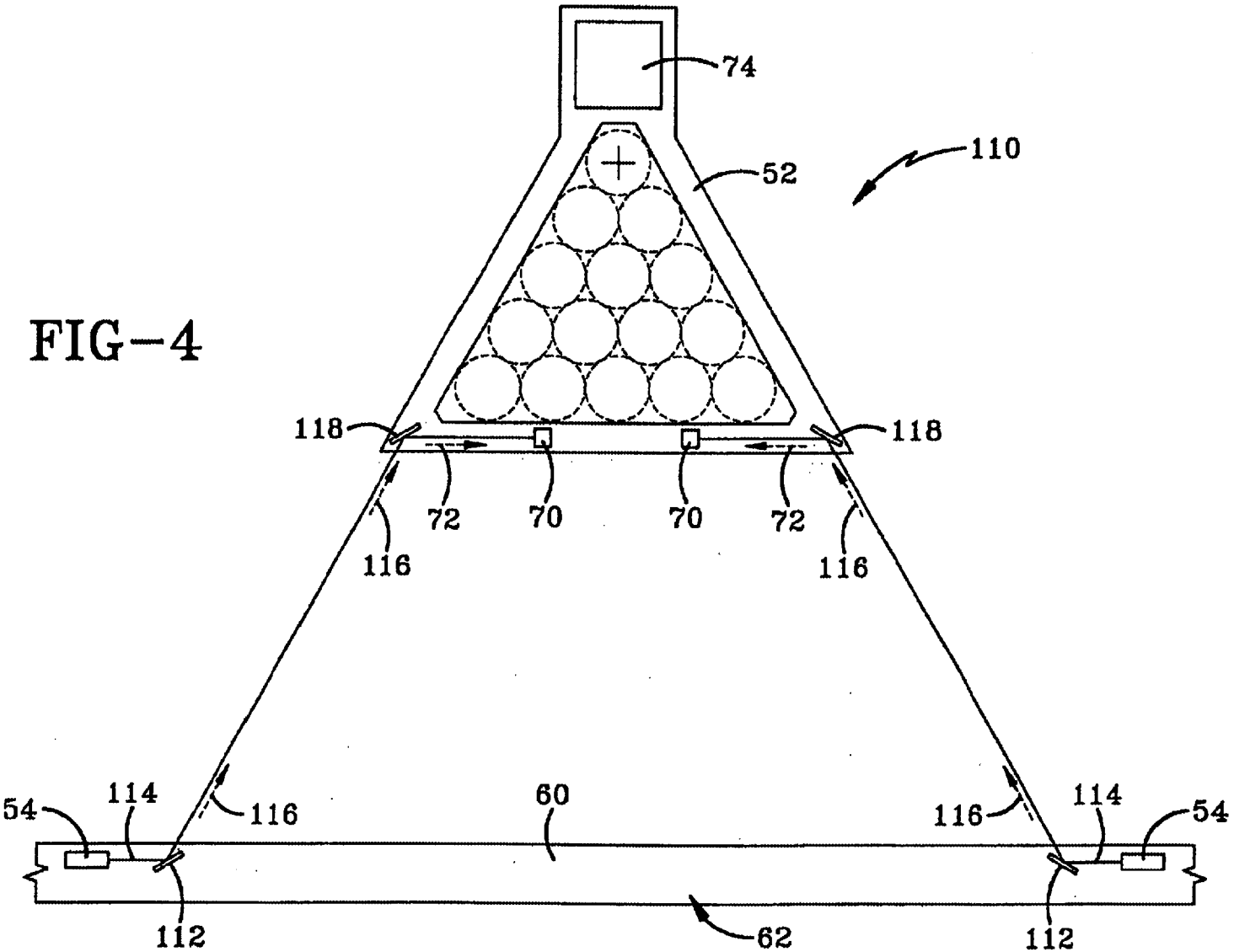
FIG. 4 is a view similar to FIG. 2 showing a third embodiment of the invention.

The third embodiment of the locator system is depicted in FIG. 4 and is indicated generally by the numeral 110. System 110 also includes various elements described above and the same numbers are used to refer to these elements. System 110 locates light sources 54 in foot rail 60. Light sources 54 may be aligned directly with the correct position of rack 52 or may be disposed parallel to the longitudinal direction of foot rail 60 as depicted in FIG. 4. In this configuration, mirrors 112 are used to redirect light beams 114 from light sources 54 to the locating direction 116. Rack 52 includes mirrors 118 to accept light beams 116 and direct them into photodetectors 70. In another embodiment, photodetectors 70 may be disposed at the corners of rack 52 so that light beams 116 immediately encounter photodetectors 70 as soon as they reach rack 52.

Mirrors 112 may be any of a variety of devices known in the art for redirecting light beam 114 into light beam 116.

Light sources 54 may be built into foot rail 60 or may be placed under the bumper if room permits.

Figure 5:
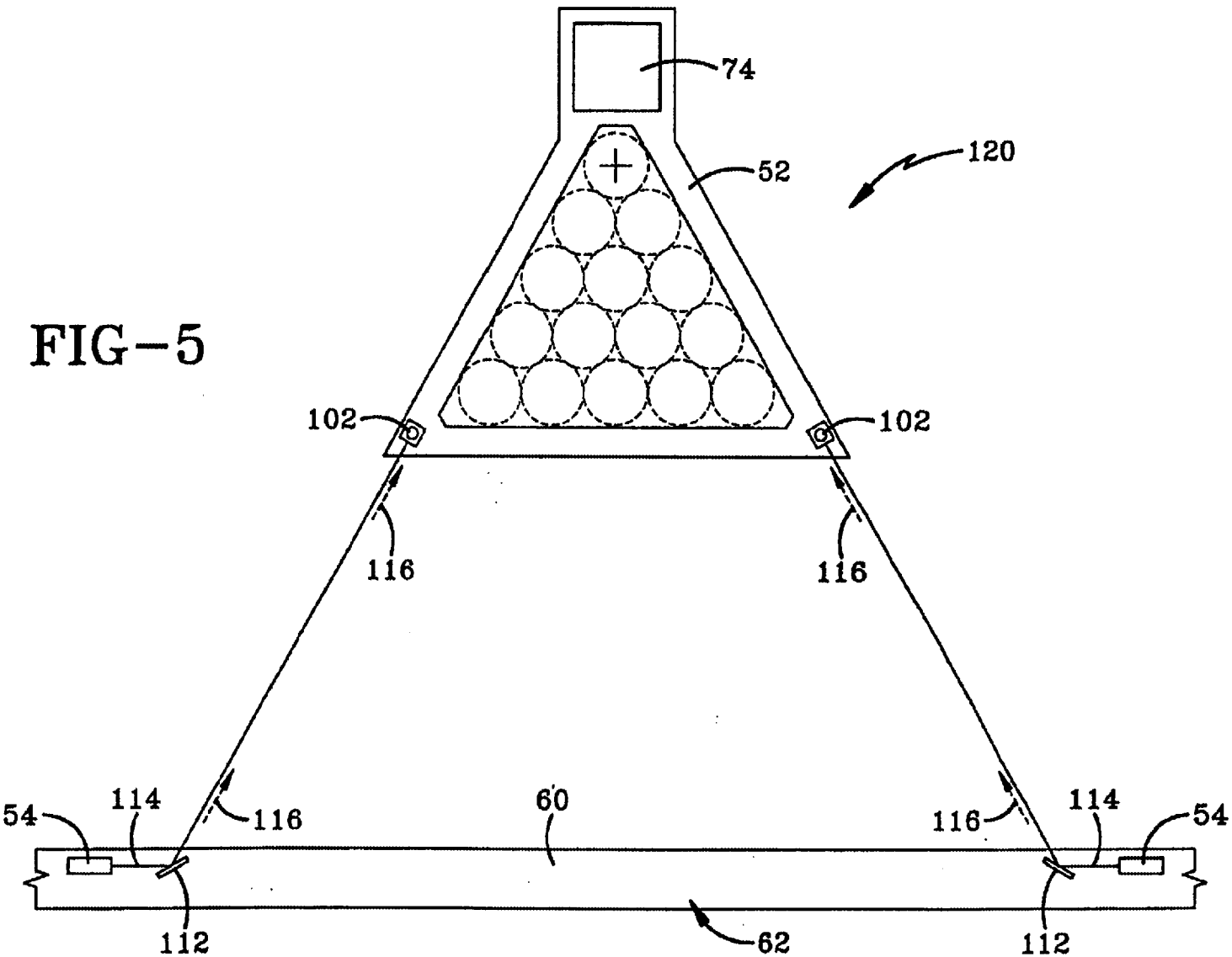
FIG. 5 is a view similar to FIG. 2 showing a fourth embodiment of the invention.

The fourth embodiment of the invention is depicted in FIG. 5 and is indicated generally by the numeral 120. System 120 is similar to system 110 except that photodetectors 70 are replaced with diffusers 102 positioned on rack 52 to immediately intercept beams 116.

Accordingly, the improved rack locator apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the rack locator is constructed and used, the characteristics of the construction, and the advantageous new and useful results obtained; the new and useful structures, devices, elements, arrangements, parts, and combinations are set forth in the appended claims.

What is claimed is:

1. A rack for a billiards table; the rack being adapted to position billiards balls on the billiards table; the rack comprising:

a body;

positioning means carried by the body for creating a signal when the rack is properly positioned on the billiards table;

the positioning means includes at least one light source;

the positioning means further includes at least one of a photodetector and a diffuser; and the positioning means further includes a beam splitter element aligned with the light source and the photodetector.

2. A rack for a billiards table; the rack being adapted to position billiards balls on the billiards table; the rack comprising:

a hollow triangular body adapted to arrange a plurality of billiards balls in a triangle on a billiards table; and light means carried by the body for projecting a light beam that allows the user of the rack to determine the proper position of the rack with respect to the table.

3. The rack of claim 2, further comprising one of a photodetector and a diffuser adapted to produce an indication signal.

4. A rack for a billiards table; the rack being adapted to position billiards balls on the billiards table; the rack comprising:

a body;

light means carried by the body for projecting a light beam that allows the user of the rack to determine the proper position of the rack with respect to the table; and the light means including a pair of devices that project light beams extending at angles greater than zero with respect to each other.

5. The rack of claim 4, wherein the devices that project light beams project collimated light beams.

6. The rack of claim 4, further comprising indication means carried by the body for creating an indication signal when the rack is properly aligned.

7. The rack of claim 6, wherein the indication means creates an audio indication.

8. The rack of claim 6, wherein the indication means creates a visual indication.

9. The rack of claim 2, further comprising means for creating an audio signal when the rack is properly positioned.

10. The rack of claim 2, further comprising means for creating a visual signal when the rack is properly positioned.

11. The rack of claim 2, wherein the light means projects two beams of light in different directions.

12. The rack of claim 11, wherein the beams are collimated light beams.

* * * * *